US005730152A

United States Patent [19]

Esser

[11] Patent Number: 5,730,152

[45] Date of Patent: Mar. 24, 1998

[54] SURGICAL LIMB SUPPORT AND POSITIONING STRUCTURE

[76] Inventor: Theodor Esser, 21 William Penn Dr., Stony Brook, N.Y. 11790

[21] Appl. No.: 751,643

[22] Filed: Nov. 18, 1996

[51] Int. Cl.[6] ..... A61G 15/00

[52] U.S. Cl. ..... 128/845; 128/846; 128/878; 128/879

[58] Field of Search ..... 128/845, 846, 128/877, 878, 879, 882; 602/5, 23, 24

[56] References Cited

U.S. PATENT DOCUMENTS

| | | | |
|---|---|---|---|
| 861,272 | 7/1907 | Downey . | |
| 2,693,794 | 11/1954 | Neville . | |
| 4,390,011 | 6/1983 | Evans . | |
| 4,730,801 | 3/1988 | Cloward . | |
| 4,807,618 | 2/1989 | Auchinleck et al. . | |
| 4,964,400 | 10/1990 | Laico et al. . | |
| 5,007,912 | 4/1991 | Albrektsson | 128/882 |
| 5,025,802 | 6/1991 | Laico et al. . | |
| 5,056,535 | 10/1991 | Bonnell | 128/882 |
| 5,065,535 | 11/1991 | Gill et al. . | |
| 5,074,291 | 12/1991 | Carter . | |
| 5,127,898 | 7/1992 | McConnelll . | |
| 5,135,210 | 8/1992 | Michelson . | |
| 5,140,998 | 8/1992 | Vickers . | |
| 5,259,396 | 11/1993 | Lipari | 128/845 |
| 5,263,497 | 11/1993 | Grabenkort et al. . | |
| 5,362,302 | 11/1994 | Jensen et al. . | |
| 5,416,939 | 5/1995 | Maalouli | 128/845 |

*Primary Examiner*—Michael A. Brown
*Attorney, Agent, or Firm*—Scully, Scott, Murphy & Presser

[57] ABSTRACT

A surgical limb support and positioning structure is constructed in the nature of a stand which may be supported on a surgical table or other suitable support surface so as to facilitate ready access thereto by a surgeon or other medical personnel, and which basically consists of an upstanding structure having mutually angularly adjustable hand and forearm supporting surfaces which are hingedly articulated to each other, whereby a first planar surface portion thereof is adapted to support the forearm of the patient, and a second planar surface portion of similar configuration is adapted to provide a support for the hand and/or forearm of the patient which is to be surgically treated. A suitable adjusting arrangement for providing an angular adjustment between the two hingedly interconnected hand and forearm supporting surfaces is capable of providing a specific angular inclination of the hand relative to the forearm during surgery by locking the support plate portions in particular angular orientations relative to each other.

13 Claims, 3 Drawing Sheets

SURGICAL LIMB SUPPORT AND POSITIONING STRUCTURE

BACKGROUND OFT HE INVENTION

1. Field of the Invention

The present invention relates to a surgical limb support and positioning structure and, more particularly, pertains to a surgical limb support and positioning structure for enabling the adjustable positioning in place of the hand and forearm of a patient during the implementation of a surgical procedure; for example, such as carpal tunnel release surgery for relieving carpal tunnel syndrome.

In essence, the inventive and unique surgical limb support and positioning structure is adapted to be constructed in the nature of a stand which may be supported on a surgical table or othersuitable support surface so as to facilitate ready access thereto by a surgeon or other medical personnel, and which basically consists of an upstanding structure having mutually angularly adjustable hand and forearm supporting surfaces which are hingedly articulated to each other, whereby a first planar surface portion thereof is adapted to support the forearm of the patient, and a second planar surface portion of similar configuration is adapted to provide a support for the hand and for forearm of the patient which is to be surgically treated. A suitable adjusting arrangement for providing an angular adjustment between the two hingedly interconnected hand and forearm supporting surfaces is capable of providing a specific angular inclination of the hand relative to the forearm during surgery by locking the support plate portions in particular angular orientations relative to each other. Moreover, the stand, which as mentioned may be supported on a surgical table or other suitable preferably horizontal support surface, may also comprise of a pair of vertically extending or upright plate members which are hingedly interconnected at one end, whereby a first one of the upright plate members is fixedly connected to supporting elements of the stand adapted to rest on the support surface, and the second upright plate member is hingedly connected to the first upright plate member at one of the supporting elements so as to be pivotable to provide a variably adjustable angular relationship with the fixed or stationarily positioned first upright plate member. This second angularly adjustable or pivotable plate member mounts the forearm and hand supporting surfaces so as to be able to impart a further degree of freedom in the capability for the angular adjustment of the composite forearm and hand supporting plate structure relative to the support surface on which there rests the surgical limb support and positioning structure or stand.

2. Discussion of the Prior Art

Numerous devices and structures are currently available in the medical technology in the provision of support structures for a limb or the limbs of a patient, particularly for use during the implementation of surgical procedures where it is of extreme importance that the limb or limbs being operated on or other applicable limbs of the patient be immobilized in order to prevent the risk of possible injury to the patient caused by inadvertent or uncontrolled movements during surgery.

For example, currently utilized as a limb support and hand restraint; for instance during carpal tunnel release surgery, is a so-called bolster on which there are supported the forearm and hand of a patient in a suitable mutually angular relationship so as to provide unhindered access to the restrained hand of the patient to a surgeon intending to operate on the hand while the latter is inhibited from any movement.

However, a bolster generally does not provide for any adjustability in the positioning or angular relationship between the hand and forearm of the patient prior to or during surgery, which renders a bolster of being only of limited assistance to a surgeon in supporting the hand and forearm of the patient.

At this time, more sophisticated patient limb supporting or restraining structures have been developed in the medical technology and which, to some extent, as an improvement over a bolster in some instances provide some degree of adjustability between the positions of the hand and forearm of a patient, albeit to only an essentially limited extent.

Grabenkort, et al. U.S. Pat. No. 5,263,497 discloses an armboard for a patient which is designed to provide a constraint for the forearm of the patient when a medical device is to be applied to the patient's arm. There is some degree of adjustability present, particularly in regard to the longitudinal extension of the support, and some minor adjustability for supporting the hand. However, the degree of angular adjustment in supporting the hand and forearm portions of a patient is only of relatively limited nature.

Vickers U.S. Pat. No. 5,140,998 discloses a surgical hand restrainer in which the hand and particularly the fingers of a patient are adapted to be placed on a board and constrained for suitable clamping devices. The device does not provide any adjustability with respect to the forearm of the patient, since adjustably hinged hand and forearm supports are not disclosed therein.

Carter U.S. Pat. No. 5,074,291 discloses a hand traction surgical table on which the hand of a patient may be supported and tensioned during surgery. However, there is no disclosure of any device providing for angular adjustability in the physical orientation between the hand and the forearm of a patient.

Laico, et al. U.S. Pat. No. 5,025,802 discloses a surgical holding apparatus for distracting the ankle of a patient, wherein the leg of the patient may be adjustably supported relative to the ankle, the latter of which is strapped to a surgical support structure, and whereby adjustability is provided by a series of linkage rod mechanisms for either elevating or lowering the knee of the patient and also providing some adjustment as to the twisting or torsional and tensile forces being applied to the ankle of the patient. This device, however, is not suitable for a surgical procedure analogous to that applied to a hand during carpal tunnel release surgery, and also necessitates the provision of a relatively complex linkage system for supporting the leg and ankle of a patient.

Laico, et al. U.S. Pat. No. 4,964,400 discloses a surgical limb supporting apparatus which incorporates a tension measuring device, and whereby a threaded rod is adapted to impart tension to the limb of a patient being supported on an essentially rotatable platform. There is no disclosure providing a hand and forearm supporting device which provides for adjustability in the angular orientation between the hand and forearm supporting structures along multiple directions.

Finally, Evans U.S. Pat. No. 4,390,011 discloses an adjustable support surface for the hands of a surgeon during surgery, enabling steadying of the surgeon's hands so as to avoid the possibility of injuring a patient during the implementation of a surgical procedure. There is no disclosure or suggestion of a surgical hand and forearm supporting and positioning structure analogous to that contemplated by the present invention.

SUMMARY OF THE INVENTION

Accordingly, as described hereinabove, the present invention provides for a surgical limb support and positioning structure, particularly for the hand and forearm of a patient whereby angular adjustment is provided on the supporting structure between the hand and forearm portion of the patient any suitable mutual angular position; and, concurrently, further angular adjustment is provided in a transverse direction relative thereto through elements supporting the surfaces forming the hand and forearm supporting structures for pivotal positioning relative to the horizontal so as to impart a versatile angular adjustability to the structure in different degrees of freedom of motion.

It is a basic object of the present invention to provide a novel surgical limb support and positioning structure providing adjustability between various supporting surfaces to enable relative angular adjustment between the limbs of a patient.

A more specific object of the present invention resides in the provision of a surgical limb support and positioning structure, particularly for the positioning of the hand and forearm of a patient during a surgical procedure, such as carpal tunnel release surgery, whereby planar support surfaces for respectively supporting the hand and forearm of the patient are adjustable to be able to assume different angular orientations relative to each other; and a further degree of adjustability is imparted to the limb support and positioning structure so as to further enhance the angular adjustability of the hand and forearm positioning surfaces relative to a specific plane.

BRIEF DESCRIPTION OF THE DRAWINGS

Reference may now be had to the following detailed description of a preferred embodiment of the surgical limb support and positioning structure pursuant to the invention, taken in conjunction with the accompanying drawings; in which.

DETAILED DESCRIPTION OF A PREFERRED EMBODIMENT

Figure 1:
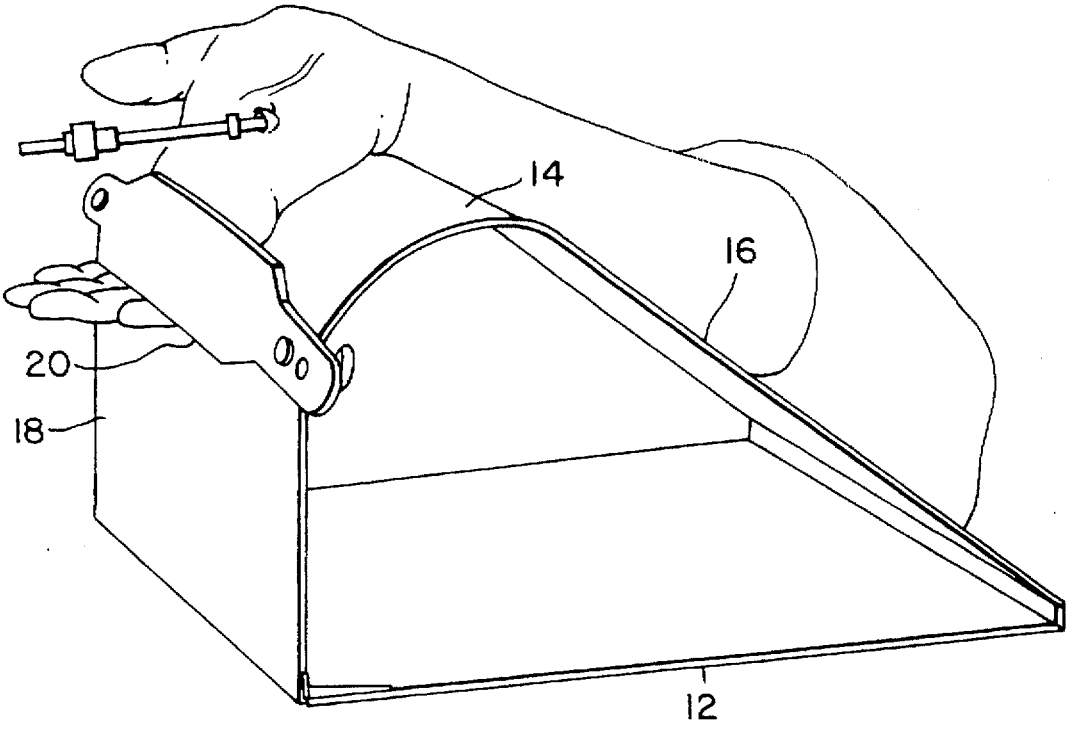
FIG. 1 illustrates a generally perspective view of a support bolster constructed pursuant to the prior art for supporting the hand and forearm of a patient during a surgical procedure.

Reverting now in more specific detail to the drawings, as shown in FIG. 1, there is disclosed a currently employed type of surgical limb support and positioning structure for a patient, and which is essentially adapted for supporting and restraining the hand and forearm of a patient during hand surgery; for instance, such as carpal tunnel release surgery. In this instance, the hand of a patient with a surgical endoscopic system illustrated therein is supported on a handrest 12 which is in the form of a bolster having a curved upper surface 14 between an inclined or sloping surface 16 enabling the lower arm portion of a patient to be supported thereon, and a substantially vertically depending front surface 18 with a strap 20 attached thereto for maintaining the hand of the patient in a hyperextended position in readiness for the surgical procedure. As may be readily ascertained this type of surgical hand and forearm support for a patient does not provide for any adjustability in the positioning of the patient's hand or forearm, and in effect limits the range of use thereof with respect to various patients and also any potentially desired adjustment of the limbs; in effect, the positional orientation between the hand and forearm, to facilitate the surgical procedure to be implemented by the surgeon.

Figure 2:
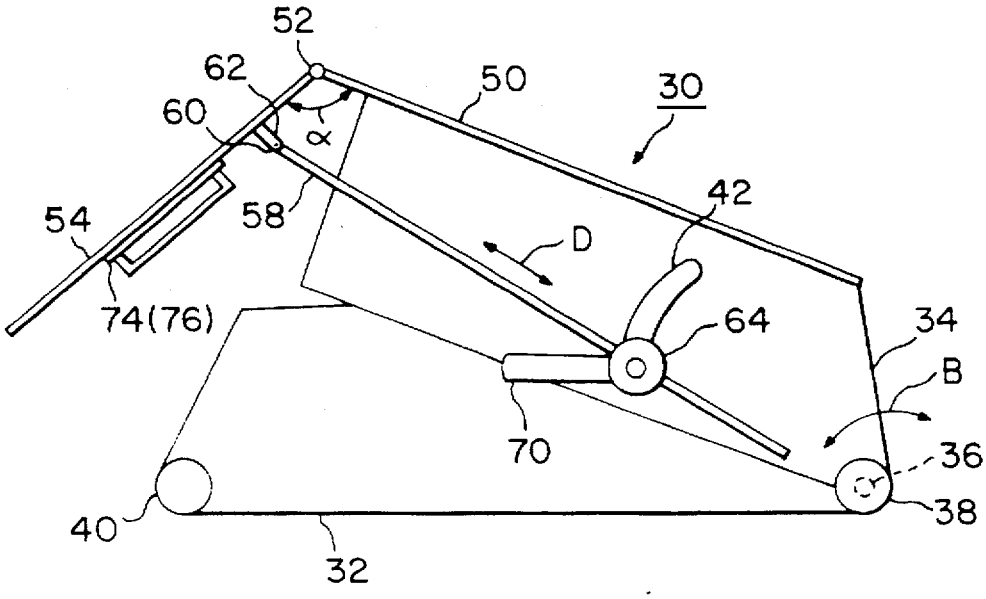
FIG. 2 illustrates a side elevational view of the inventive surgical limb support and positioning structure pursuant to the invention.
Figure 3:
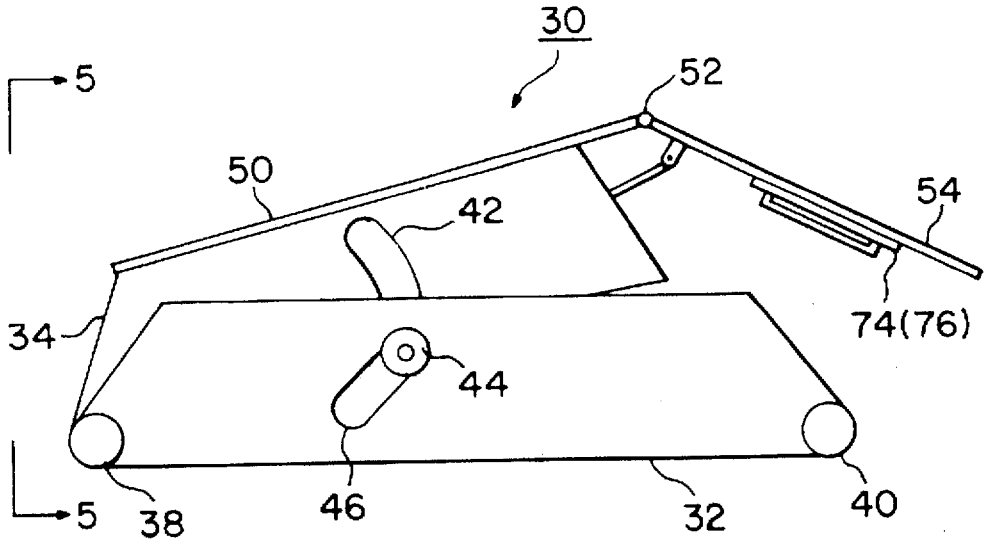
FIG. 3 illustrates a side elevational view from the opposite side of the structure.

Referring now specifically to the inventive surgical limb support and positioning structure 30 as disclosed in FIGS. 2 through 6, as shown in FIG. 2, the structure 30 comprises essentially a stand having a pair of uprightly oriented flat plate members 32 and 34 in closely parallel spaced or contiguous arrangement pivotally hinged to each other at one lower end by a pivot joint 36 which is formed as a portion of a cylindrical element 38. This element 38 is spaced from a further cylindrical element 40, which extends in parallel therewith and which is fastened to the opposite lower end of plate 32. The cylindrical elements 38, 40 extend horizontally and transversely of the plate 32 so as to provide base supports when the entire structure 30 is adapted to be positioned on either a surgical table or other suitable generally horizontal support surface so as to be readily accessible to a surgeon. The two cylindrical supports 38, 40 extend transversely of the vertical orientation of the upright plates 32, 34 which are pivotable relative to each other, so that the second plate member 34 can be pivoted upwardly or downwardly in the direction of the double-headed arrow B about the pivot point 36 so as to impart any desired angular relationship between the plates 32, 34.

A controllable angular adjustability between the two vertically oriented plate members 32, 34 is provided by the presence of a curvilinear slot 42 in the plate member 34 with a latch element extending therethrough from the other plate member 32 and which is adapted to lock the plate members together in any required mutual angular relationship through the activation of a clamping arrangement 44 having a manually operable locking lever 46.

Mounted at or fastened to the upper end of the angularly adjustable plate member 34 is a transverse plate 50 which is adapted to form a planar support surface for the forearm of a patient. Hingedly connected to the end of the plate 50 which is upwardly and downwardly movable through a hinge structure 52 is a second flat plate 54 which forms a planar support surface for the hand of a patient and is essentially an adjustable continuation of the plate 50 in the provision of support surfaces.

Figure 5:
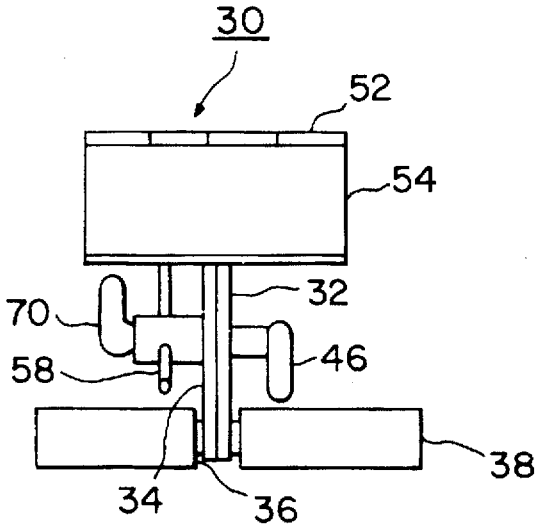
FIG. 5 illustrates an end view of the structure taken along the direction of line 5—5 in FIG. 3.

Angular adjustability for subtending an angle $\alpha$ between the two flat plates 50 and 54 supporting, respectively, the forearm and the hand of a patient so as to enable suitable required orientation between the patient's limbs, as shown in FIG. 1 of the drawings, is provided by a linkage rod 58 which is hingedly articulated by means of a pivot joint 60 one end of a second shorter rod member 62 which has its other end rigidly fastened to the lower surface of the hand-supporting plate 54, and whereby the lengthier linkage rod 58 is adapted to axially slide through an opening formed in a latching trunnion 64 mounted on the upright plate member 32 and which has a clamping element extending through the curvilinear slot 42 in plate member 34. This slidable movement in the direction of double-headed arrow D of linkage rod 58 can be controlled and locked in position through the activation of a latching lever 70 of the latching trunnion 64 for clamping the linkage rod and thereby fixing the relative angular position between plates 50 and 54, as also illustrated in FIG. 5 of the drawings.

Vertical tilting adjustment for the composite structure comprising both the forearm supporting plate 50 and hand supporting plate 54, in addition to their mutually adjustable angular relationship provided by the linkage rod 58, is imparted by pivoting the upstandingly oriented stand plate member 34 about pivot joint 36 along the direction of arrow B and locking the plate member 34 in a specified angular position relative to the horizontal or surface on which plate member 32 is supported by means of the cylindrical base support elements 38, 40. This structure provides a versatility for the adjustment between the plates 32, 34 and also plates 50, 54 in different orientations and planes; both as to the angular orientation of the composite forearm and hand supporting plates 50, 54 relative to the horizontally pivoting plate member 34 and also the inclination or angular adjustment of the hand supporting plate 54 relative to the forearm supporting plate 50 by means of linkage rod 58.

Figure 4:
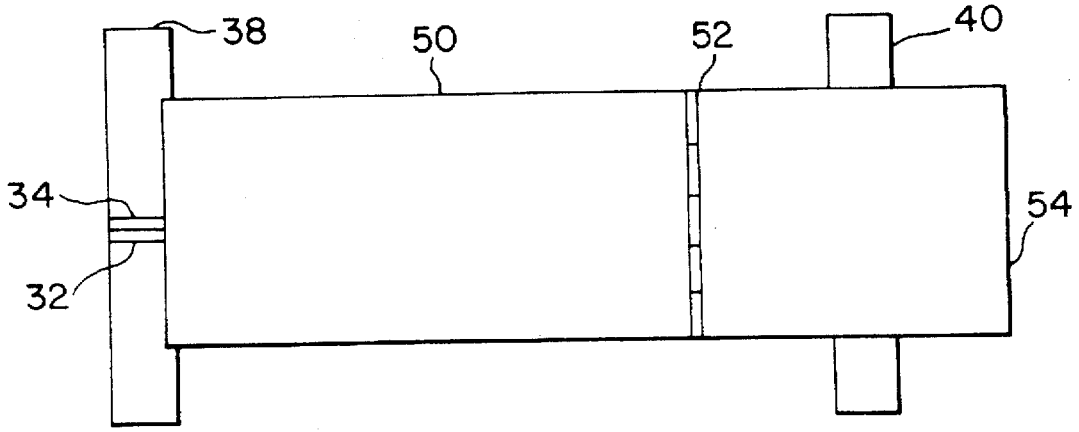
FIG. 4 illustrates a top plan view of the surgical limb support and positioning structure.
Figure 6:
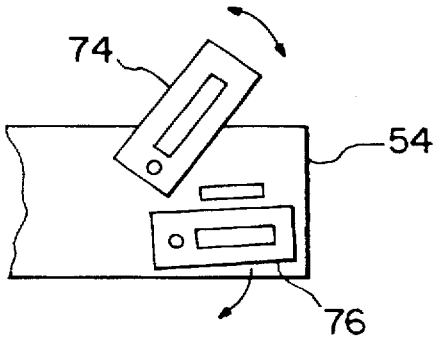
FIG. 6 illustrates a fragmentary view of a segment of the surgical limb support and positioning structure taken along the direction of arrow A in FIG. 3.

Further support for the thumb of a patient's hand resting on the surface of plate 54 is provided by the lower surface of the hand-supporting plate being equipped with selectively outwardly pivotable plate elements 74 and 76, as shown in FIGS. 4 and 6 of the drawings, whereby these selectively provide support for either a right-hand thumb or a left-hand thumb depending on which hand of a patient is supported on plate 54, while the other of the plate elements 74 or 76 may remain in its retracted out of the way position beneath the hand-supporting plate 54.

The entire surgical limb support and positioning structure may be constituted of stainless steel; preferably of surgical steel quality, and during surgery suitable cushioning components (not shown) may be located on the upper surfaces of the hand and forearm support plates 50, 54 in order to render the patient comfortable while the hand and forearm are positioned on the structure during surgery.

From the foregoing, it becomes readily apparent that the present invention discloses a surgical limb and positioning structure, particularly a hand and forearm support and positioning structure which may be employed during surgical procedures such as carpal tunnel release and which provides a wide range of adjustability in various orientations so as to enable the patient's limbs to be adjusted in the most comfortable position and also to facilitating ready access to a surgeon.

Furthermore, although the foregoing patient limb support and positioning structure has been described in connection with supporting the hand and forearm of a patient, it is readily apparent to one of skill in the art that by appropriately sizing the overall dimensions of the entire structure, the latter may also be adapted for supporting the leg of a patient; for example, whereby the lower leg portion and ankle are supported on the component described hereinabove as the hand-supporting plate and the upper leg or thigh supported on the component described as the forearm-supporting plate. Naturally, other limbs of a patient may also be conceivably supported thereon by suitably adjusting and dimensioning devices or structures of this type in conformance with a surgeon's requirements.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A surgical limb support and positioning structure comprising a stand including a first element positionable on a support surface; second element articulated to said first element for pivotal movement relative thereto; means mounted on said second element for supporting limbs of a patient, said means comprising a first support surface for supporting a portion of the limbs and a second support surface articulated to said first support surface for supporting a further portion of the limbs, said second support surface being tiltably adjustable relative to said first support surface, said first and second elements of said stand each being flat plate members arranged in closely spaced parallel upright orientations; stand support means fastened to opposite lower ends of said first plate member, said stand support means each comprising an elongate cylindrical member extending transversely of the plane of Said first plate member so as to form a base for said structure.

2. A structure as claimed in claim 1, wherein one of said cylindrical members comprises a pivot joint for hingedly connecting said first plate member to a lower end of said second plate member.

3. A structure as claimed in claim 1, wherein a slot is formed in said second plate member; and latching means on said first plage member engageable in said slot for locking said second plate member to said first plate member in predetermined angularly adjusted positions relative to said first plate member.

4. A structure as claimed in claim 3, wherein said latching means comprises a manually operable lever on said first plate member for selectively actuating said latching means to facilitate pivotal adjustment of said second plate member relative to said first plate member.

5. A structure as claimed in claim 1, wherein said first limb supporting surface comprises a flat plate fastened to an upper edge of said second plate member and being oriented to have an upper planar surface extending perpendicular to and transversely thereof.

6. A structure as claimed in claim 5, wherein said second limb supporting surface comprises a flat plate having an upper planar surface; and hinge means pivotally articulating one end of said second limb supporting surface to an end of said first limb supporting surface distant from the pivot joint between the first and second flat plate members of said stand.

7. A structure as claimed in claim 6, wherein said flat plates forming said first and second limb supporting surfaces are each rectangular in configuration and are hinged together at contiguous edges of said plates to facilitate pivotable movement of said second limb supporting plate relative to said first limb supporting plate.

8. A structure as claimed in claim 7, wherein linkage means interconnects said second limb supporting plate with said upright first stand plate member; and means on said first stand plate member slidably engageable by said linkage means for adjusting the angular relationship between said first and second limb supporting surfaces.

9. A structure as claimed in claim 8, wherein a trunnion is fastened to said first stand plate member, said linkage means comprising an elongate rod axially slidable through an aperture in said trunnion for effectuating a pivoting movement of said second limb supporting surface relative to said first limb supporting surface; and latching means on said trunnion for locking said linkage rod against axial movement so as to determine the angle subtended between said first and second limb supporting surfaces.

10. A structure as claimed in claim 6, wherein said first and second limb supporting surfaces are adapted to respectively support the forearm and hand of a patient.

11. A structure as claimed in claim 10, wherein plate means are hingedly journaled to the lower surface of said first limb supporting plate so as to be selectively outwardly extendable to form support surfaces for the thumb of selectively the right or left hand of the patient.

12. A structure as claimed in claim 1, wherein the components of said structure are essentially constituted of stainless steel.

13. A structure as claimed in claim 1, wherein said structure comprises a support during carpal tunnel release surgery.

* * * * *